United States Patent [19]

Landa et al.

[11] Patent Number: 4,598,992

[45] Date of Patent: Jul. 8, 1986

[54] ELECTROPHOTOGRAPHIC COPIER HAVING READILY REMOVABLE DRUM AND IMPROVED DRIVE SYSTEM THEREFOR

[75] Inventors: Benzion Landa, Alberta, Canada; Josef Rosen, Rehovot; Avner Schneider, Ness Ziona, both of Israel

[73] Assignee: Savin Corporation, Stamford, Conn.

[21] Appl. No.: 628,389

[22] Filed: Jul. 6, 1984

[51] Int. Cl.[4] ..... G03G 15/00

[52] U.S. Cl. ..... 355/3 DR

[58] Field of Search ..... 355/3 R, 3 DR, 3 BE, 355/16

[56] References Cited

U.S. PATENT DOCUMENTS

| | | | |
|---|---|---|---|
| 3,490,841 | 1/1970 | Cely, Jr. et al. | 355/3 R |
| 3,667,840 | 6/1972 | Engel et al. | 355/3 DR |
| 3,907,423 | 9/1975 | Hayashi et al. | 355/10 |
| 3,957,368 | 5/1976 | Goshima et al. | 355/8 |
| 3,966,316 | 6/1976 | Pfeifer et al. | 355/3 DR |
| 3,998,584 | 12/1976 | Wada et al. | 219/469 X |
| 4,114,998 | 9/1978 | Shimizu et al. | 355/3 DR |
| 4,325,626 | 4/1982 | Murata et al. | 355/3 DR |

*Primary Examiner*—Arthur T. Grimley
*Assistant Examiner*—J. Pendegrass
*Attorney, Agent, or Firm*—Shenier & O'Connor

[57] ABSTRACT

An electrophotographic copier in which a manually releasable locking mechanism normally locates the machine drum in an operative position in the machine cabinet in which peripheral edge portions of the drum engage a pair of friction rollers positioned adjacent to the image receiving portion of the drum. Upon release of the locking mechanism and without the use of tools the drum automatically moves to a location at which at least a part thereof is clear of the machine housing at an access opening thereof.

15 Claims, 7 Drawing Figures

ELECTROPHOTOGRAPHIC COPIER HAVING READILY REMOVABLE DRUM AND IMPROVED DRIVE SYSTEM THEREFOR

FIELD OF THE INVENTION

Our invention relates to an electrophotographic copier of the type incorporating a drum carrying a photoconductive layer on which the image is formed and, more specifically, to an arrangement for readily removably mounting the drum in operative position in the copier housing and to an improved drum drive assembly.

BACKGROUND OF THE INVENTION

There are known in the prior art electrophotographic copying machines in which the electrostatic image to be developed is formed on a drum carrying a photoconductive surface layer. The drum is mounted for rotary movement and is driven in synchronism with a scanning mechanism to cause an electrostatic latent image of an original to be formed on the surface of the drum. In the prior art, the drum is mounted for rotary movement in bearings which are at fixed locations on the machine frame. The drive normally is provided by gearing or the like from a drive motor to the drum.

One of the defects of systems of the prior art discussed hereinabove is that of "banding" or repetitive density variations in the direction of drum rotation. These density of print changes may be the result of changes in drum speed owing to cogging of the gear drive. Another defect of such systems results from variation in the distance from an optical window in the original imaging path to the imaging portion of the drum surface such as may result from slight eccentricities of the drum or out-of-roundness thereof.

Further in operation of electrophotographic copiers of the type discussed hereinabove, the photosensitive layer may become marred or its electrostatic characteristics may become degraded after a lengthy lapse of time or the production of a very large number of copies. When this occurs to the extent that clear copies can no longer be produced, the photoreceptor drum must be taken from the machine housing and cleaned or it must be replaced by a new drum. In the arrangements of the prior art for supporting the drum in the machine cabinet, removal of the drum is a difficult operation requiring tools. Further, owing to the nature of the photoconductive layer, the drum must be very carefully handled to avoid damage to the surface thereof. Damage to other components of the machine must be avoided in removing the drum. While there are known in the prior art various expedients for mounting the drum in the machine cabinet so as to permit removal thereof, in general these arrangements are not particularly expeditious and do not solve the problems outlined hereinabove.

SUMMARY OF THE INVENTION

In general, our invention contemplates the provision of an electrophotographic copier in which a manually releasable locking mechanism normally locks the machine drum in operative position within the machine cabinet with the peripheral edge portions of the drum in engagement with a pair of friction rollers, one of which is driven to rotate the drum. The arrangement so positions the drum in engagement with the drive system as to locate the portion of the drum surface receiving the image at a constant distance from an optical window in the original imaging path. Upon release of the manually operable locking mechanism and without the use of tools the drum automatically moves to a position at which it is clear of the machine housing. This is accomplished without interference with any of the other operating parts of the machine. The same drum or a fresh drum can be moved into operative position with the drive system in a completely manual operation without the necessity of employing tools. At the same time other parts of the machine are restored to operative positions with relation to the drum.

OBJECTS OF THE INVENTION

One object of our invention is to provide an electrophotographic copier having means for positioning the copier drum with the portion of the image receiving surface thereof at a constant distance from an optical window in the original imaging path.

Another object of our invention is to provide an electrophotographic copier having a friction drum drive which produces a smooth rotation of the drum.

A further object of our invention is to provide an electrophotographic copier having manually operable means for releasably holding the machine drum in operative position with relation to the drum drive.

Still another object of our invention is to provide an electrophotographic copier with manually operable releasable means for moving the machine drum from its operative position within the machine cabinet to a position clear of the cabinet at which it is readily accessible for removal or replacement.

Other and further objects of our invention will be apparent from the following description.

BRIEF DESCRIPTION OF THE DRAWINGS

In the accompanying drawings to which reference is made in the instant specification and which are to be read in conjunction therewith and in which like reference characters are used to indicate like parts in the various views.

DESCRIPTION OF THE PREFERRED EMBODIMENT

Figure 1:
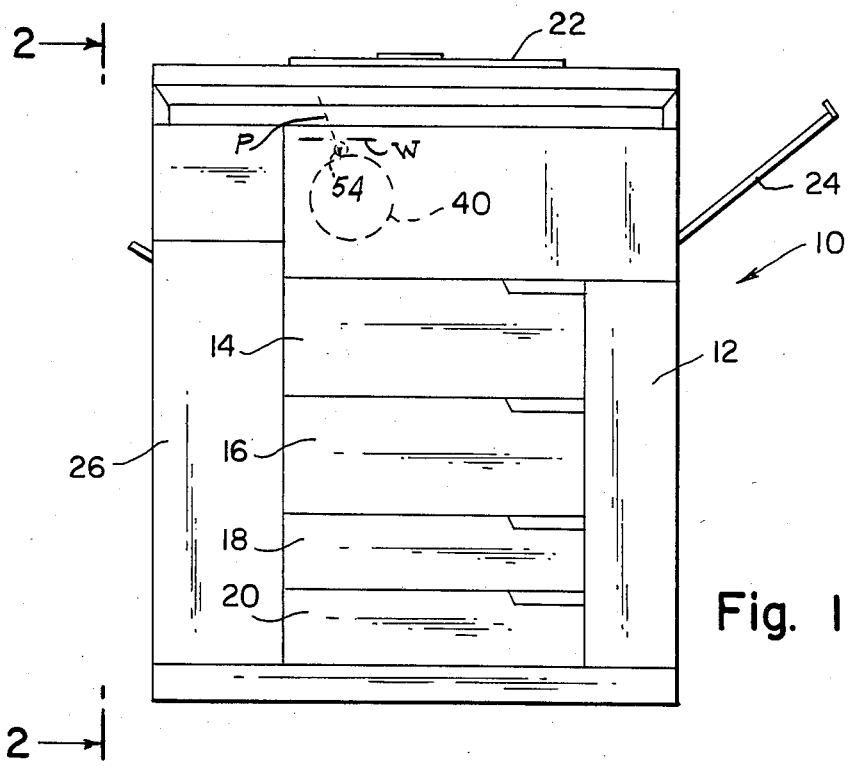
FIG. 1 is a front elevation of one type of copying machine with which our drum drive and removal arrangement may be used.

A copying machine indicated generally by the reference character 10, which may incorporate our drum removal arrangement to be described more fully hereinbelow, includes a cabinet 12 having four paper trays 14, 16, 18 and 20 containing supplies of copy paper on which an image of an original is to be reproduced. The machine 10 includes a platen cover 22 which may be lifted to permit an original to be placed face down on the machine platen (not shown). In operation of the machine a copy is made in a manner known to the art and delivered to the user on a copy tray 24.

Figure 2:
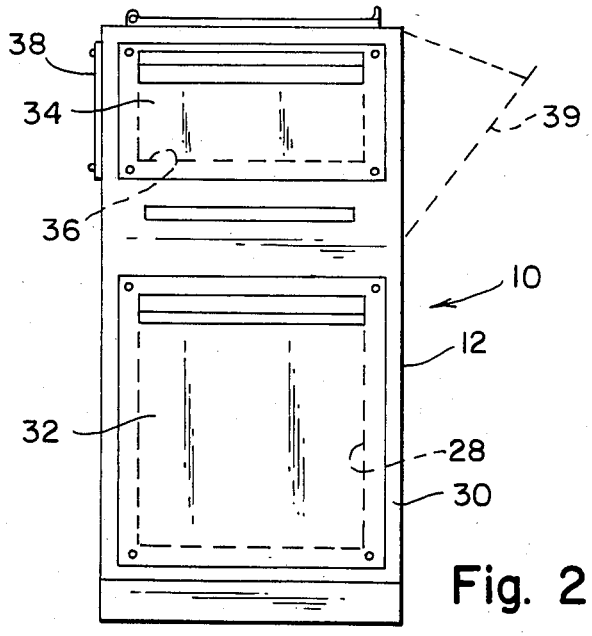
FIG. 2 is a left side elevation of the machine shown in FIG. 1.

The cabinet 12 may include a process liquid space 26 to the left of the trays behind an access opening 28 in the side 30 of the cabinet. Opening 28 normally is closed by a door 32 which may be secured by any suitable means, such for example as screws. Side 30 is provided with an upper door or removable panel 34 which covers a second side access opening 36. The space immediately behind the opening 36 may normally be occupied, for example, by a bottle of clear dispersant. We also provide the back of the cabinet 12 with a movable back panel 38. The front of the cabinet normally is provided with a readily openable front wall section 39 illustrated in broken lines in FIG. 2.

Machine 10 includes a drum 40, the surface of which carries a suitable photoconductor, such for example as amorphous silicon. An image of the original to be copied is directed by a scanning optical system along an imaging path and through a window W onto the drum. As is known in the art, the drum 40 not only is one of the more expensive components of the machine but also it requires extremely careful handling to avoid damage such as scratching of the photoconductor surface.

Figure 3:
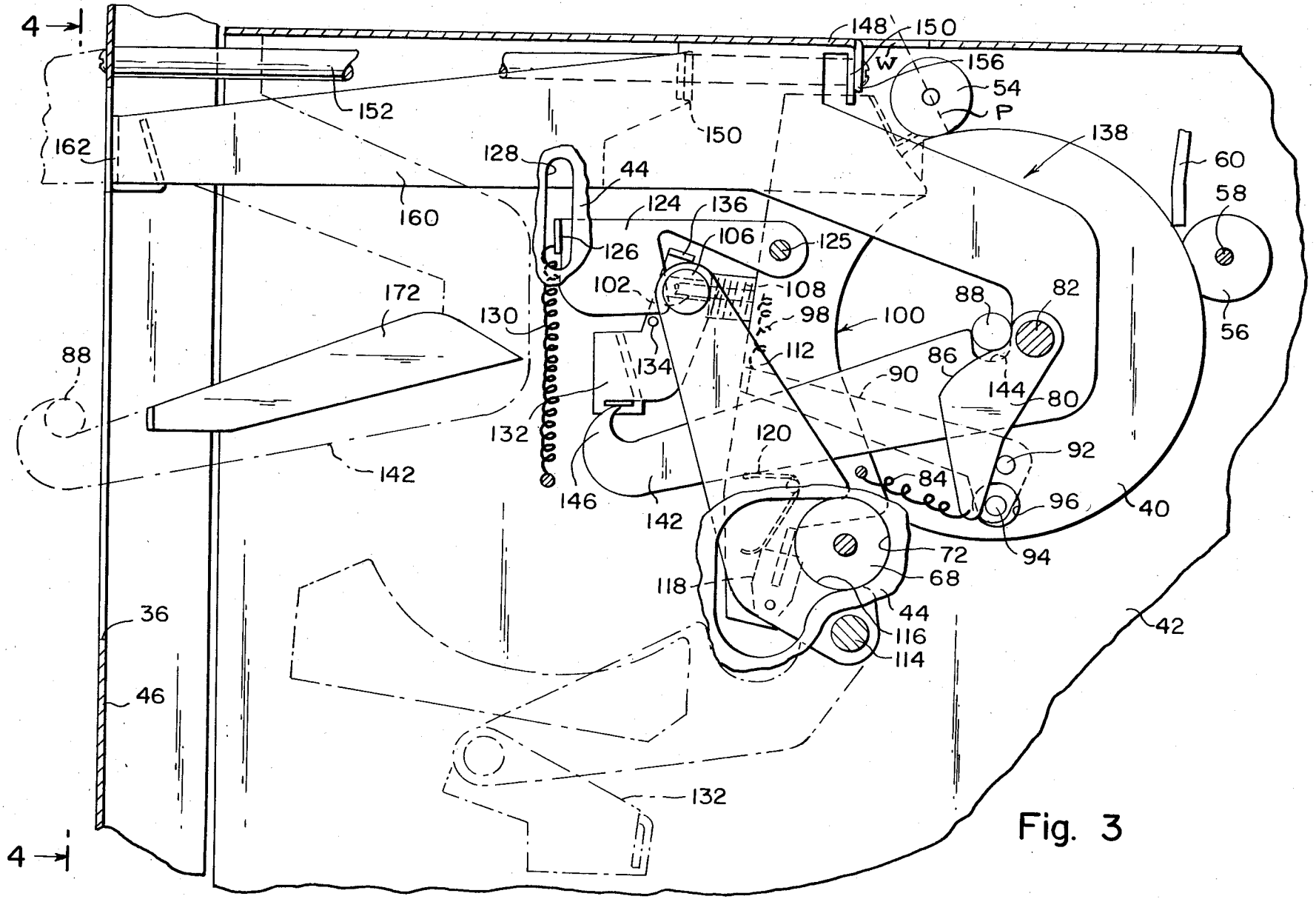
FIG. 3 is a fragmentary front elevation of the machine shown in FIG. 1 with parts removed and with other parts broken away.
Figure 4:
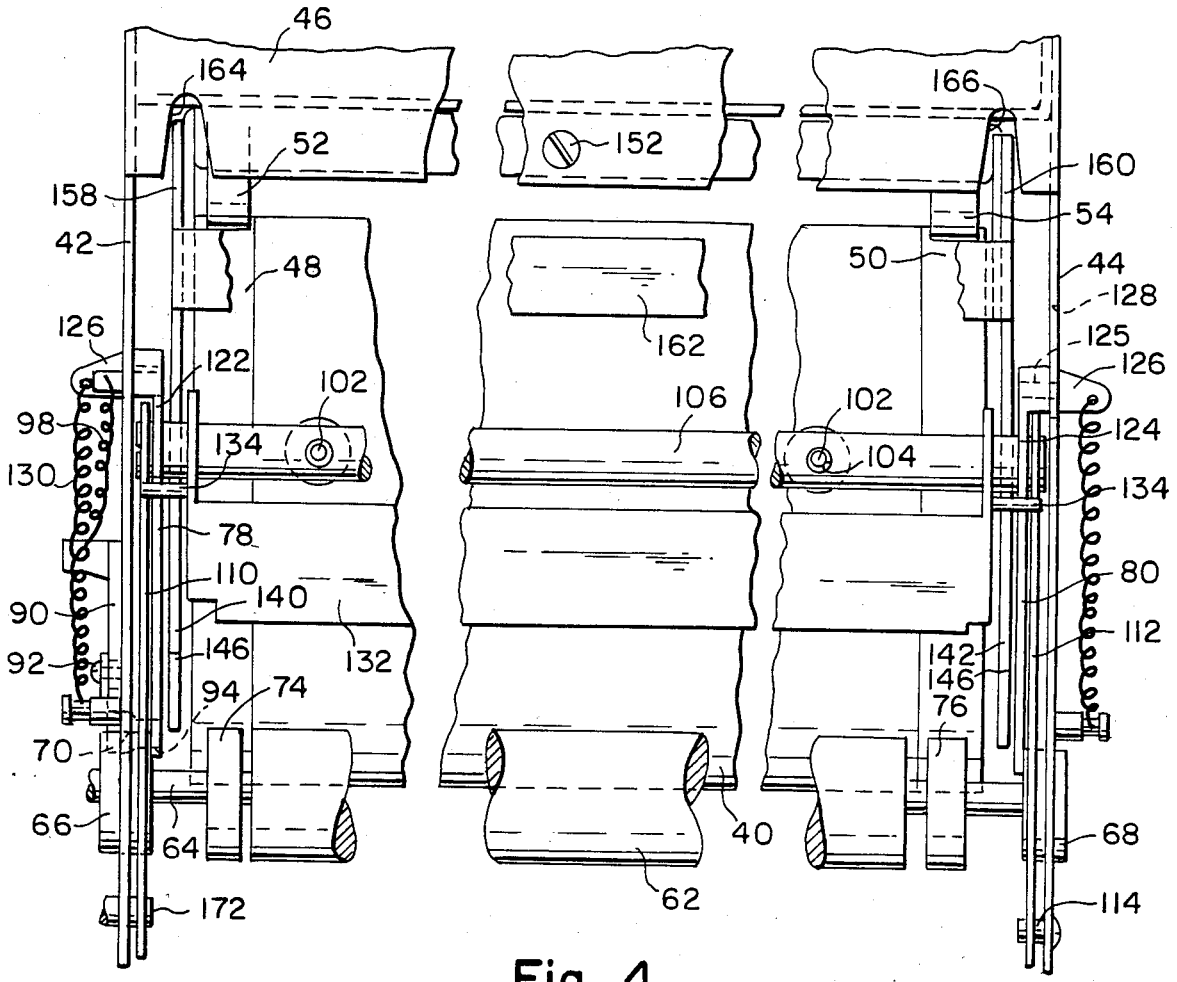
FIG. 4 is a fragmentary left side elevation with parts broken away taken along the line 4—4 of FIG. 3.

Referring now to FIGS. 3 and 4, cabinet 12 houses a frame including a back panel 42, a front panel 44 and a left-end panel 46 having the opening 36.

As is known in the art, the drum 40 has respective hard annealed edge areas 48 and 50 on the surface thereof which are not active in the photocopying process. In one form of drive system for a copier to which our drum removal arrangement may be applied, a driven friction roller 52 engages the drum surface area 48 while an idler roller 54 engages the surface 50, both at a location adjacent to window W. Rollers 52 and 54 and their associated structures will be described more fully hereinbelow.

A foam cleaning roller 56 carried by a shaft 58 engages the surface of the drum 50 and is driven to produce a scrubbing action on the same in a manner known to the art. Another element of the cleaning system is a scraper blade 60 which in the operative position thereof resiliently engages the drum surface. The details of the structure associated with roller 56 and blade 60 will be described more fully hereinbelow.

The copying machine with which our drum removal system is employed, incorporates a "reverse" roller 62 which is held in closely spaced relationship to the drum surface and which is driven with the surface thereof moving in a direction opposite to that of the drum surface in the area of adjacency of the two surfaces to remove excess liquid from the surface of the drum. A roller of this type is more fully shown and described in Hayashi et al Pat. No. 3,907,423. Roller 62 is provided with a shaft 64 having a pair of support bearings 66 and 68 adapted to ride in respective slots 70 and 72 in the panels 42 and 44. Shaft 64 also carries a pair of spacer bearings 74 and 76 which, in the operative position of the reverse roller, engage the drum areas 48 and 50. The bearings 74 and 76 have diameters slightly greater than that of the roller 62 so as to provide the required clearance between the roller surface and that of the drum 40.

Our drum support and removal assembly includes a pair of drum positioning cams 78 and 80 supported on respective pivot pins 82 in the side panels 42 and 44. Springs 84 urge the cams 78 and 80 to rotate on their pivot pins 82 in such a direction as to urge cam surfaces 86 into engagement with the drum trunnions 88.

We provide our assembly with a crank arm 90 supported on a pin 92 carried by the back panel 42. Crank 90 carries a cam pin 94 which extends through an opening 96 in panel 42 to a position at which it can engage the lower end of cam 78. A spring 98 urges the crank 90 to rotate in a clockwise direction as viewed in FIG. 3.

The machine 10 includes a developer electrode assembly indicated generally by the reference character 100. The assembly 100 carries a pair of spaced pins 102 which extend into a pair of spaced transverse bores 104 in a positioning bar 106. Springs 108 normally urge the assembly 100 away from the bar 106 into an operative position at which portions of the assembly 100 engage drum portions 48 and 50.

We mount the positioning bar 106 on a pair of spaced positioning arms 110 and 112 carried by respective pivot pins 114 on the side panels 42 and 44. We form the arms 110 and 112 with respective recesses 116 for receiving the reverse roller support bearings 66 and 68.

Arms 110 and 112 also pivotally support the reverse roller wiper blade assembly 118. Springs 120 normally urge the assembly 118 to a position at which the wiper blade is in engagement with the reverse roller. Our assembly includes a pair of locking pawls 122 and 124 pivotally supported on respective pins 125 carried by the panels 42 and 44. The pawls 122 and 124 have lugs 126 extending laterally outwardly through respective slots 128 in the panels 42 and 44. Springs 130 urge the pawls 122 and 124 to the position shown in FIG. 3 at which they releasably retain bar 106 in the position shown.

A handle 132 is swingably supported on the rod 106 by means of side arms on the handle. Respective pins 134 on the handle arms extend outwardly under the respective pawls 122 and 124. The upper end of each of the handle arms carries a stop 136.

Our assembly includes a cradle indicated generally by the reference character 138 having a pair of arms 140 and 142 at the sides of the drum 40. The arms 140 and 142 have respective slots 144 adapted to receive the drum trunnions BB in one condition of the apparatus to be described more fully hereinbelow, as well as hooks 146 at the ends thereof for receiving the trunnions 88 in another position of the apparatus. A cross connector 148 at the upper ends of the arms has respective flanges 150 formed with openings for receiving a slide bar 152 supported in a bracket 156 and in panel 46 so as to support the cradle for sliding movement between a housed position and a position at which the drum 40 is readily accessible from outside the machine cabinet. Respective arm extensions 158 and 160 are connected by a handle 162. We form the upper edge of the access opening 36 with respective slots 164 and 166 for accommodating extensions 158 and 160 when the cradle 138 is withdrawn from the cabinet 12 in a manner to be described hereinbelow. The inner surfaces of frame panels 40 and 42 carry respective stationary cams 172, the function of which will be described hereinbelow.

Figure 5:
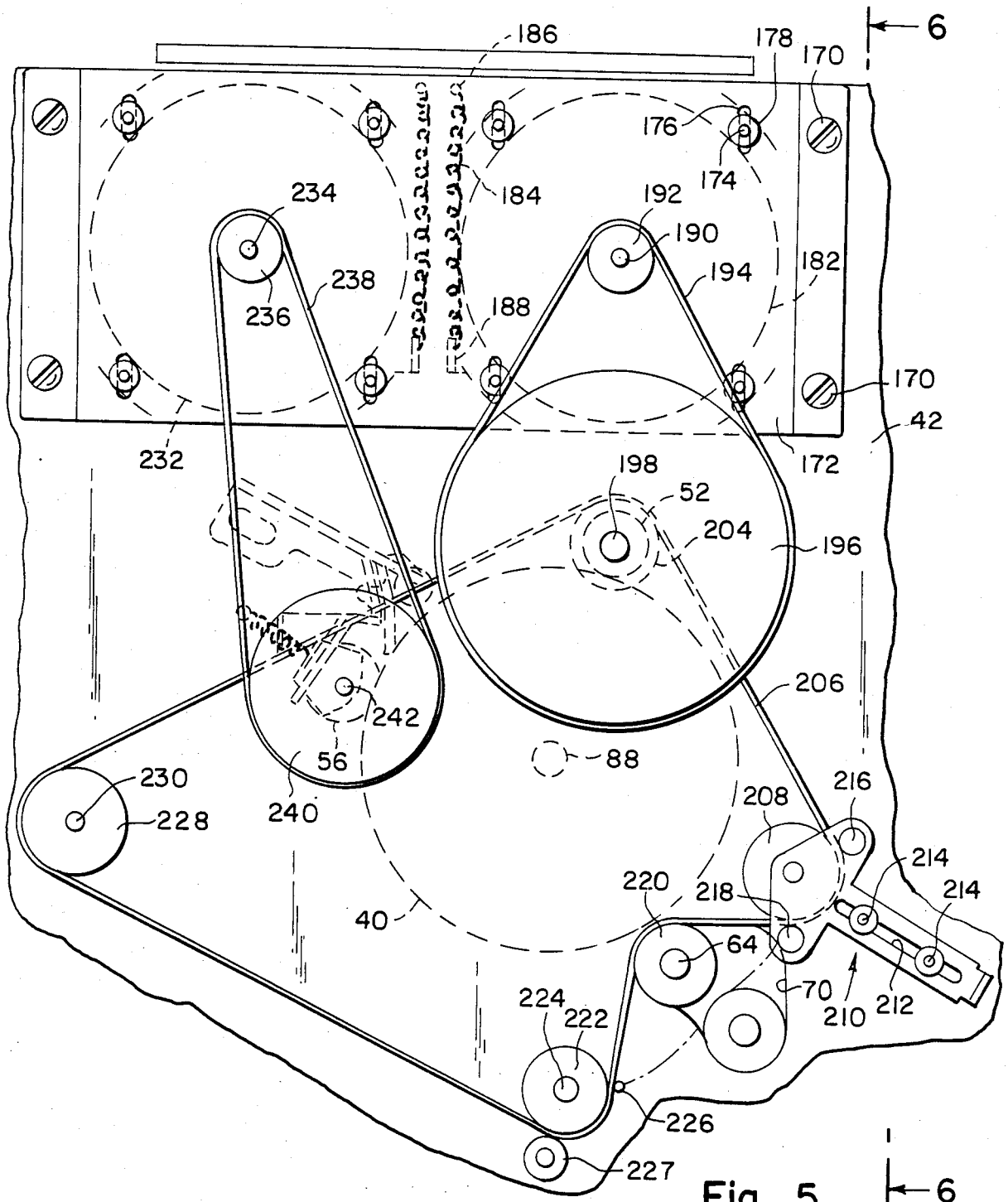
FIG. 5 is a fragmentary rear elevation of the machine shown in FIG. 1 with parts broken away and with other parts removed.
Figure 6:
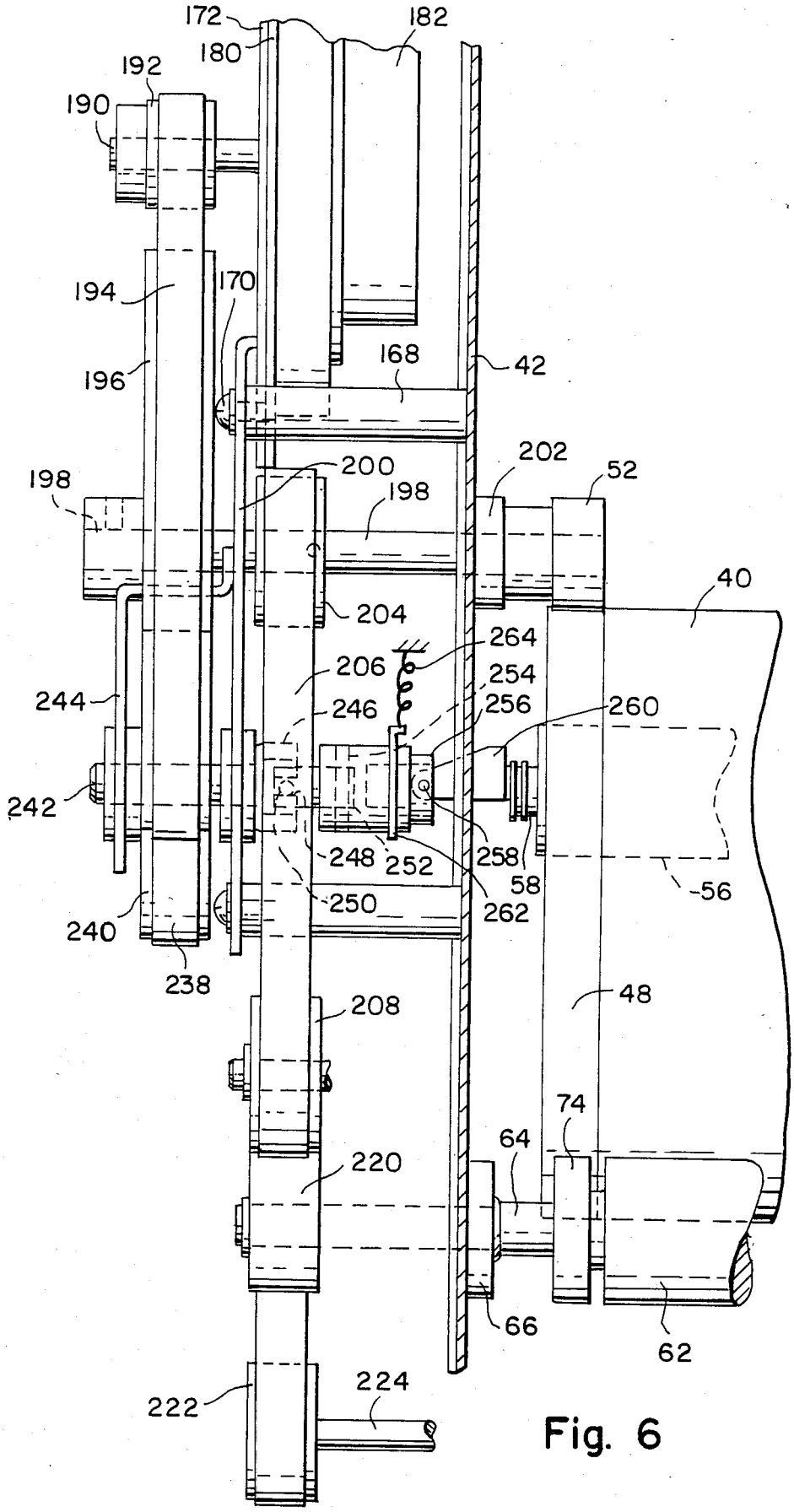
FIG. 6 is a fragmentary side elevation taken along the line 6—6 of FIG. 5.

Referring now to FIGS. 5 and 6, in the drive system for our ready access improved electrophotographic copier a plurality of spacers 168 and screws 170 secure a motor mounting plate 172 to the rear frame plate 42 of the machine. The main drive motor 182 of our machine has a housing 180 provided with a plurality of threaded studs 174 extending through straight slots 176 in the mounting plate 172. Nuts 178 normally secure the studs 174 in adjusted positions in the slots 176. A spring 184 extending between a pin 186 on frame plate 42 and a tab 188 carried by the motor housing 180 positions the motor housing 180 relative to the plate 172 so as properly to tension the main drive belt to be described hereinbelow. To adjust belt tension the nuts 178 are loosened to permit the spring 184 to exert an upward force on the motor housing as viewed in FIG. 5 to provide the proper belt tension. Then nuts 178 can be tightened.

Main drive motor 182 has an output shaft 190 carrying a smooth surface pulley 192 which receives a smooth drive belt 194 so as to drive the belt by friction. Belt 194 drives a pulley 196 carried by a shaft 198 rotatably supported by suitable bearings such as bearing 202 in side plate 42 and in a bracket 200 spaced outboard from the plate 42.

Shaft 198 carries a second smooth pulley 204 which drives a smooth flat belt 206. Belt 206 extends around a belt tensioning pulley 208 rotatably supported on a frame 210. A slot 212 in the frame 210 receives bolts 214 secured to the side plate 42 to permit adjustment of the position of the frame 210 and thus of the tension in belt 206. Frame 210 carries a pair of belt retaining pins 216 and 218 which prevent untracking of the belt when tension is lost in a manner to be described hereinbelow.

After leaving the tension roller 208, belt 206 engages a pulley 220 carried by the reverse roller shaft 64 so as to provide a drive for the reverse roller.

From the reverse roller drive pulley 220, belt 206 extends around a registration roller drive pulley 222 carried by a registration roller shaft 224. We provide respective belt retaining pins 226 and 227 similar to pins 216 and 218 but associated with the pulley 224. Finally, belt 206 extends around and drives a fuser transport drive pulley 228 carried by a shaft 230. From pulley 228 belt 206 extends back to pulley 204. Since neither the registration system per se nor the fuser per se form a part of the invention to which this application relates, they will not be described in detail.

Our drive system also includes a cleaning roller drive motor 232 which is mounted on the plate 172 in the same manner as that described hereinabove in connection with the main drive motor 182. Motor 232 has an output shaft 234 carrying a pulley 236 which drives a belt 238. Belt 238 drives a pulley 240 on a shaft 242 rotatably supported in suitable bearings on bracket 202 and on a second bracket 244 spaced outboard from bracket 200. Shaft 242 carries a coupling member 246 having a recess provided with slots 248 for receiving the ends of a cross pin 250 carried by a rod 252 carried by a pin 254 in a coupling member 256. Pin 252 extends in a direction at right angles to the direction of pin 250. A pin 258 on coupling member 256 and extending at right angles to pin 254 receives a fitting 260 secured to the shaft 58 of the cleaning roller 56. It will readily be appreciated that the structure just described forms a universal coupling between shaft 242 and shaft 58. This coupling permits the movement, to be described, of the cleaning roller 56 from an operative position in engagement with the surface of the photoconductive drum 40 to an inoperative position at which it is out of engagement with the surface of the drum. A bracket 262 which receives the coupling member 256 is biased by a spring 264 normally to urge the cleaning roller 56 away from the surface of the drum 40.

Figure 7:
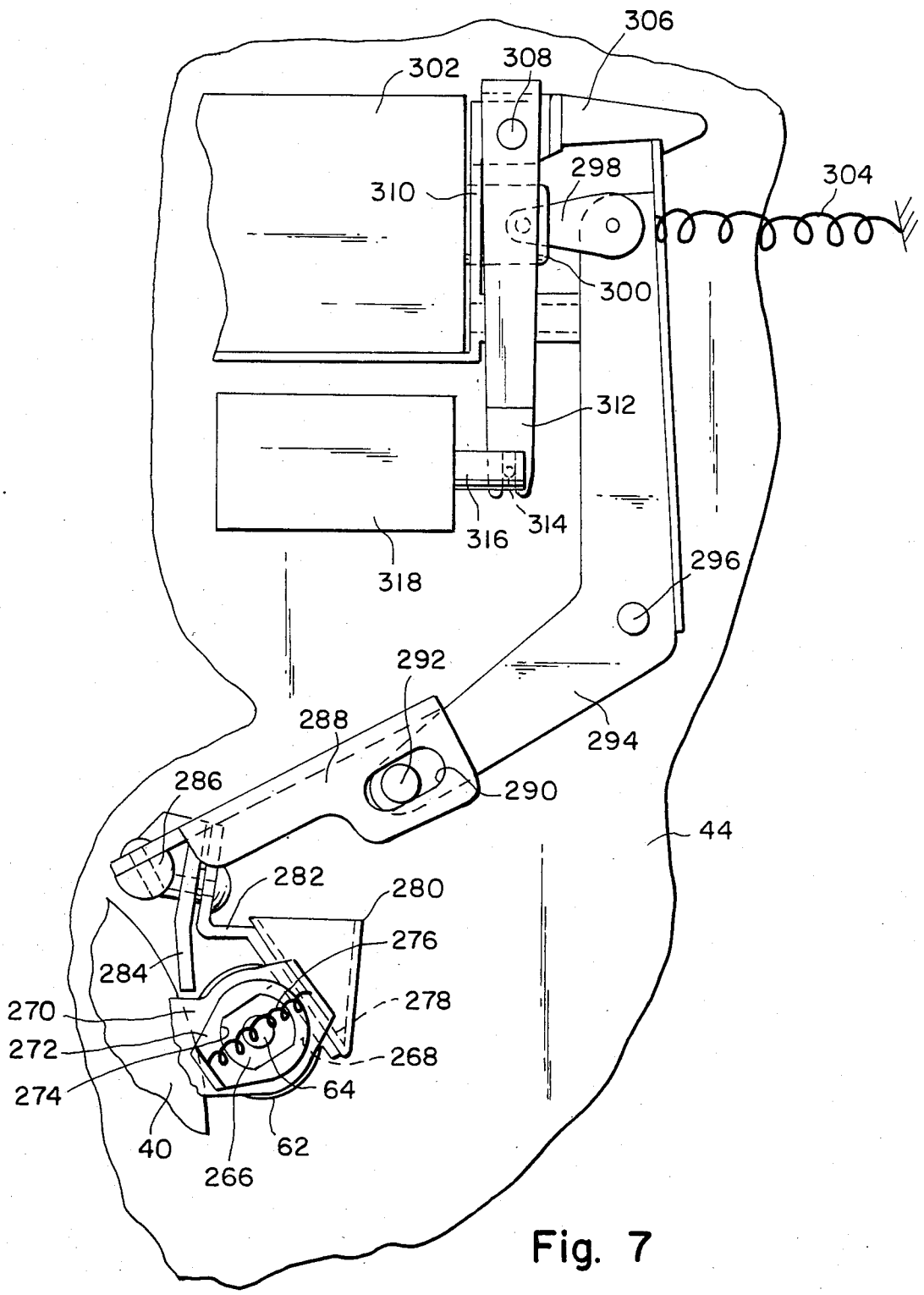
FIG. 7 is a fragmentary front elevation illustrating the cleaning roller actuating mechanism of the machine shown in FIG. 1.

Referring now to FIG. 7, the rear end of the cleaning roller shaft 64 is supported in a bearing 266 provided with flats by means of which the bearing is supported for sliding movement toward and away from the drum 40 in a slot 268 formed in a bracket 270 carried by the frame side plate 44. Bearing 266 also carries a plate 272 by means of a slot 274. A spring 276 extending between plate 272 and the bracket 270 normally urges bearing 266 to a position away from the drum 40 at which the cleaning roller 62 is out of engagement with the surface of the drum.

The cleaning system of the machine with which our drive system is employed includes a squeegee plate 278 forming part of a cleaning liquid supply reservoir 280 supported by a bracket 282. We secure an assembly of the bracket 282 and the cleaning plate 284 to a pivot shaft 286 which supports the assembly for movement between an inoperative position at which the squeegee plate is out of engagement with the roller 62 and in which the cleaning blade 284 is out of engagement with the drum surface and an operative position at which the squeegee plate 278 urges the cleaning roller 62 into engagement with the surface of the drum and at which the blade 284 engages the drum surface.

We secure an arm 288 to the shaft 286 for movement therewith. An elongated slot 290 in the arm 288 receives a pin 292 carried by a bell crank 294 supported on a pivot pin 296 on the frame plate 44. A link 298 connects the upper end of the bell crank 294 to the armature 300 of a solenoid 302. A spring 304 biases the bell crank 294 for movement in a counterclockwise direction.

The cleaning system actuating assembly includes a bell crank latch 306 pivotally supported on a pin 308 carried by a bracket 310. Pin 308 also supports a lever 312, the lower end of which is bifurcated to receive a pin 314 on the armature 316 of a solenoid 318.

In normal operation of the copying machine 10 provided with our drum positioning and drive mechanism the parts occupy the relative positions illustrated in FIG. 3 in which cleaning roller 56 is urged against the drum 40, as are the spacing bearings of the reverse roller 62, so that the peripheral edge portions 48 and 50 of the drum 40 are in engagement with the friction drive roll 52 and with the idler roller 54. In the course of a copying operation the friction drive roller 52 provides a smooth drum drive with no problems of cogging and the like. At the same time the drum mounting system, in combination with the drive, so positions the drum that the image receiving portion thereof adjacent to the top of the drum is always at the same distance from a window indicated by W in FIG. 1 through which the image is focussed on the drum.

When it is necessary or desirable to remove the drum 40 for servicing, the operator first grasps the handle 132 and rotates it in a clockwise direction as viewed in FIG. 3, to cause pins 134 to engage pawls 124 to release the bar 106 to permit the electrode assembly 100 to move to the dot-dash position illustrated in FIG. 3 and to permit the reverse roller support bearings to move to the lower ends of the slots 70 and 72. Next, it may be necessary to actuate lever 90 to permit the trunnions 88 to move to the bottoms of recesses 144 to permit the drum 40 to clear the drive roller 52 and idler roller 54. When that has been done, the operator grasps the handle 162 to move the cradle 138 to the left as viewed in FIG. 3. In the course of this operation, as the trunnions 88 engage the stationary cams 172 they are raised up out of slots 144 and permitted to roll downwardly along the cams and along the arms 140 and 142 until they are caught by the hooks 146 on the arms 140 and 142. When the cradle 138 has been moved to its fully withdrawn position, as illustrated in the dot-dash lines of FIG. 3, drum 40 is more than halfway out of the opening 36 so as to be fully accessible to a service person for removal. If any of the reverse roller, reverse roller wiper, or electrode assembly are scheduled for cleaning and inspection, the best time to accomplish the inspection is while the photoreceptor is removed. The reverse roller can be removed through the enlarged portion of the side frame cutout 72. This can be accomplished by manipulating arms 110 and 112 until the reverse roller is properly positioned for removal. It is to be noted that the reverse roller drive system permits this removal to be accomplished without releasing any gears or belts or the like.

It will be seen that we have accomplished the objects of our invention. We have provided a drum drive which ensures that the image receiving surface portion of the drum is always at a fixed distance from a window in the original imaging path. Our arrangement provides a smooth drive which does not involve problems of cogging and the like. Our drum supporting arrangement permits the drum to be readily manually removed from the machine without the use of tools. It also facilitates removal and servicing of other parts of the machine, such for example as the reverse roller assembly.

It will be understood that certain features and subcombinations are of utility and may be employed without reference to other features and subcombinations. This is contemplated by and is within the scope of our claims without departing from the spirit of our invention. It is, therefore, to be understood that our invention is not to be limited to the specific details shown and described.

Having thus described our invention, what we claim is:

1. In a copying machine, apparatus including in combination, a cabinet formed with an access opening, a drum adapted to occupy an operative position on said frame within said cabinet, said operative position being relatively remote from said access opening, first manually operable means for releasably locking said drum in its operative position, said first manually operable means comprising a member mounted on said frame for movement between a release position out of engagement with said drum and a locking position in engagement with said drum, a cradle adapted to receive said drum upon movement of said member to its release position, and means mounting said cradle on said frame for movement of said drum along a path between a first position at which said drum is adjacent to said operative position and a second position at which said drum is accessible at said opening, said locking position of said member being in said drum path.

2. Apparatus as in claim 1 in which said member is a roller mounted for swinging movement on said frame.

3. Apparatus as in claim 2 including means for driving said roller and means for reestablishing the operative relationship between said roller and said drive means upon movement of said roller from said release position to said locking position.

4. Apparatus as in claim 1 including a plurality of rolling elements in engagement with the periphery of said drum for holding said drum in said operative position.

5. Apparatus as in claim 4 including means for driving one of said rolling elements to drive said drum.

6. Apparatus as in claim 4 in which said member is one of said rolling elements and means mounting said one element for swinging movement on said frame.

7. Apparatus as in claim 2, including a development electrode assembly, means mounting said development electrode assembly on said frame between an operative position with relation to said drum and an inoperative position, said operative position being in said path and said inoperative position being out of said path, said releasable locking means normally holding said electrode assembly in said operative position and permitting movement of the electrode assembly to its inoperative position upon release of the locking means.

8. Apparatus as in claim 1 in which said cradle is adapted to support said drum in a retracted position on the cradle in the first position of the cradle on the frame and an extended position in the second position of the cradle on the frame, and means responsive to movement of said cradle from its first position to its second position for moving said drum from its retracted position to its extended position.

9. Apparatus as in claim 8 in which said drum has trunnions and in which said means responsive to movement of said cradle comprises cams on said frame for engaging said trunnions.

10. Apparatus as in claim 8 in which said drum has trunnions, said cradle comprising a pair of arms, each of said arms having a recess for receiving one of said trunnions in said retracted position of the drum, means for retaining a trunnion in said extended position of the drum and a ramp extending downwardly from said recess to retaining means.

11. Apparatus as in claim 10 in which said means responsive to movement of said cradle comprises cams on said frames for lifting said trunnions out of said recesses and onto said ramps.

12. In a copying machine having a window in an imaging path along which an image of an original is directed, apparatus including in combination a cabinet having a wall formed with an opening, a drum, means for accurately locating said drum in operative relationship with said window, a manually movable cradle adapted to receive said drum, means mounting said cradle in said cabinet for movement on said cabinet along a path between a first position at which said drum is approximately position with respect to said window and a second position at which said drum is readily accessible at said opening, and manually actuatable locking means mounted on said cabinet for movement between a released position and a locking position, said means for accurately locating said drum comprising means responsive to movement of said locking means to said locking position with said cradle in said first position for moving said drum to a position at which it is accurately positioned with respect to said window.

13. Apparatus as in claim 12 in which said cradle is mounted for sliding movement.

14. Apparatus as in claim 12 in which said means for accurately locating said drum comprises a pair of rolling elements within said cabinet in engagement with the periphery of said drum and in which said means responsive to movement of said locking means comprises a third rolling element adapted to engage ther periphery of the drum and means mounting said third rolling element for movement between a position in said path in engagement with said drum periphery and a position out of said path.

15. Apparatus as in claim 14 in which one of said pair of rolling elements is a cleaning roller.

* * * * *